US005614875A

United States Patent [19]

Jang et al.

[11] Patent Number: 5,614,875

[45] Date of Patent: Mar. 25, 1997

[54] DUAL BLOCK CERAMIC RESONATOR FILTER HAVING COMMON ELECTRODE DEFINING COUPLING/TUNING CAPACITORS

[75] Inventors: Sei-Joo Jang; Kyung-Jong Park, both of Seoul, Rep. of Korea

[73] Assignee: Dae Ryun Electronics, Inc., Seoul, Rep. of Korea

[21] Appl. No.: 277,353

[22] Filed: Jul. 19, 1994

[51] Int. Cl.[6] ..... H01P 1/205

[52] U.S. Cl. ..... 333/202; 333/206; 333/222; 333/207

[58] Field of Search ..... 333/202, 206, 333/207, 222

[56] References Cited

U.S. PATENT DOCUMENTS 4,431,977 2/1984 Sokola ..... 333/206

FOREIGN PATENT DOCUMENTS 4051602 2/1992 Japan ..... 333/206
4056501 2/1992 Japan ..... 333/202 DB
4095401 3/1992 Japan ..... 333/202 DB

OTHER PUBLICATIONS

General Treatment of Klystron Resonant Cavities, Fujisawa, *IRE Transactions on Microwave Theory and Techniques*, Oct. 1958, pp. 344–358.

*Primary Examiner*—Benny Lee
*Attorney, Agent, or Firm*—Finnegan, Henderson, Farabow, Garrett & Dunner, L.L.P.

[57] ABSTRACT

A re-entrant dielectric ceramic resonator and filters incorporating a plurality thereof are suitable for use in mobile and portable radio transmitting and receiving devices. The inventive re-entrant dielectric ceramic resonator comprises a dielectric means comprised of a dielectric ceramic material having a top surface, a bottom surface and outer side surfaces, the top and bottom surfaces being flat and parallel to each other, the dielectric means further having a cylindrical hole extending partially from the top surface toward the bottom surface thereby forming an inner side surface and an inner bottom surface, the inner bottom surface being flat and parallel to the bottom surface. Furthermore, the top and outer side surfaces of the dielectric means and the inner side and inner bottom surfaces of the cylindrical hole are covered completely with a first conductive material, and the bottom surface of the dielectric means is partially covered with a second conductive material, to thereby form a coupling/tuning capacitor between the first conductive material covering the inner bottom surface and the second conductive material partially covering the bottom surface, whereby the re-entrant dielectric ceramic resonator is constructed.

5 Claims, 10 Drawing Sheets

DUAL BLOCK CERAMIC RESONATOR FILTER HAVING COMMON ELECTRODE DEFINING COUPLING/TUNING CAPACITORS

FIELD OF THE INVENTION

The present invention relates to dielectric ceramic filters; and, more particularly, to an improved dielectric ceramic resonator and filter that is particularly well adapted for use in mobile and portable radio transmitting and receiving devices.

BACKGROUND OF THE INVENTION

Conventional dielectric ceramic filters offer high performance with scalability which make them ideally suited for use in mobile and portable radio transceivers. They are usually comprised of a plurality of dielectric ceramic resonators that are typically foreshortened, short-circuited quarter-wavelength coaxial.

In FIG. 1, there is illustrated a prior art dielectrically loaded bandpass filter 100 employing a conventional input connector 101 and a conventional output connector 103. Such a filter is more fully described in U.S. Pat. No. 4,431,977, entitled "Ceramic Bandpass Filter" and is incorporated by reference herein. The filter 100 comprises a block 105 which is generally made of a dielectric ceramic material with a conductive material selectively plated thereon, having a low loss, a high dielectric constant, and a low temperature coefficient of the dielectric constant, e.g., a ceramic compound comprising barium oxide, titanium oxide and zirconium oxide.

A dielectric filter such as that of the block 105 of the filter 100 is generally covered or plated, except for areas 107, with an electrically conductive material, for example, silver or copper. The dielectric filter such as the block 105 includes a multiplicity of holes 109, wherein each of the holes extends from the top surface to the bottom surface thereof and is likewise plated with the electrically conductive material. The plating of the holes is electrically connected with the conductive plating covering the block 105 at one end side of the holes 109 and is isolated from the plating covering the block 105 at the opposite end side of the holes 109. Further, the plating of the holes 109 at the isolated one end side may extend onto the top surface of the block 105. Thus, each of the plated holes 109 is essentially a foreshortened coaxial resonator comprised of a short coaxial transmission line having a length selected for desired filter response characteristics. Although the block 105 is shown in FIG. 1 with six plated holes, any number of plated holes may be utilized depending upon the filter response characteristics desired.

The plating of the holes 109 in the filter block 105 is illustrated more clearly in a cross sectional view cut through any one of the holes 109. As shown in FIG. 2, the conductive plating 204 on the dielectric material 202 extends through the hole 201 to the top surface with the exception of a circular portion 240 around the hole 201. Other conductive plating arrangements may also be utilized. In FIG. 3, the conductive plating 304 on the dielectric material 302 extends through the hole 301 to the bottom surface with the exception of the portion 340. The plating arrangement in FIG. 3 is substantially identical to that in FIG. 2, the difference being that the unplated portion 340 is on the bottom surface instead of on the top surface. In FIG. 4, the conductive plating 404 on the dielectric material 402 extends partially through the hole 401 leaving a portion of the hole 401 unplated. The plating arrangement in FIG. 4 can also be reversed as in FIG. 3 so that the unplated portion 440 is on the bottom surface.

Coupling between the plated hole resonators is accomplished through the dielectric material and may be adjusted or controlled by varying the width of the dielectric material and the distance between adjacent coaxial resonators. The width of the dielectric material between adjacent holes 109 (see FIG. 1) can be adjusted in any suitable regular or irregular manner, e.g., by using slots, cylindrical holes, square or retactangular holes, or irregularly shaped holes.

As shown in FIG. 1, RF signals are capacitively coupled to and from the dielectric filter 100 by means of input and output electrodes, 111, 113, respectively, which in turn, are coupled to input and output connectors 101, 103, respectively.

The resonant frequency of the coaxial resonators provided by the plated holes 109 is determined primarily by the depth of each hole, the thickness of the dielectric block, and the amount of plating removed from the top of the filter near the hole. Tuning of the filter 100 may be accomplished by the removal of additional ground plating or resonator plating extending upon the top of each plated hole. The removal of plating for tuning the filter can easily be automated, and can be accomplished by means of a laser, sandblast trimmer, or other suitable trimming devices while monitoring the return loss angle of the filter.

SUMMARY OF THE INVENTION

It is a primary object of the present invention to provide a dielectric ceramic resonator having a novel structure capable of storing equal amounts of electric and magnetic energies at its resonant frequency.

It is another object of the present invention to provide a dielectric ceramic filter comprising a plurality of the dielectric ceramic resonators having the novel structure.

It is a further object of the present invention to provide a dielectric ceramic resonator and filter having an improved capacitive coupling/tuning capability.

It is still another object of the present invention to provide a dielectric ceramic resonator and filter whose response characteristics can be easily modified.

In accordance with one aspect of the present invention, there is provided a re-entrant dielectric ceramic resonator comprising a dielectric means made of a dielectric ceramic material having a top surface, a bottom surface and outer side surfaces, the top and bottom surfaces being flat and parallel to each other, said dielectric means further having a cylindrical hole extending partially from the top surface toward the bottom surface to thereby form an inner side surface and an inner bottom surface, wherein the inner bottom surface being flat and parallel to the bottom surface, and the top and outer side surfaces of said dielectric means and the inner side and inner bottom surfaces of the cylindrical hole being covered completely with a first conductive material, and the bottom surface of said dielectric means being partially covered with a second-conductive material to thereby form a coupling/tuning capacitor between the first conductive material covering the inner bottom surface and the second conductive material partially covering the bottom surface, whereby the re-entrant dielectric ceramic resonator is constructed.

In accordance with another aspect of the present invention, there is provided a single-block dielectric ceramic filter, made of a plurality of re-entrant dieletric ceramic resonators, comprising:

a dielectric means made of a dielectric ceramic material having a top surface, a bottom surface and four outer side surfaces, the top and bottom surfaces being flat and parallel to each other, said dielectric means further having at least two cylindrical holes, each of the cylindrical holes partially extending from the top surface toward the bottom surface, each of the cylindrical holes having an inner side surface and an inner bottom surface, the inner bottom surface being flat and parallel to the bottom surface, and each of the cylindrical holes being disposed at a predetermined distance from one another;

a first electrode means comprised of a first conductive material disposed on the bottom surface of the dielectric means, the first electrode means being located below one of the cylindrical holes; and a second electrode means comprised of a second conductive material disposed on the bottom surface of said dielectric means, the second electrode means being located below a cylindrical hole other than the cylindrical hole located above the first electrode means; and a third conductive material completely covering said dielectric means, except the portions surrounding the first and second electrode means, thereby forming a pair of coupling/tuning capacitors between the first electrode means and the third conductive material covering the inner bottom surface of the cylindrical hole located above the first electrode means and between the second electrode means and the inner bottom surface of the cylindrical hole located above the second electrode means, whereby a re-entrant resonator is produced for each of the cylindrical holes.

In accordance with yet another aspect of the present invention, there is provided a dual-block dielectric ceramic filter made of a plurality of re-entrant dielectric ceramic resonators, comprising:

a dielectric means consisting of a pair of dielectric bodies, each of the dielectric bodies made of a dielectric ceramic material having a top surface, a bottom surface and four outer side surfaces, the top and bottom surfaces being flat and parallel to each other, each of the dielectric bodies further having at least two cylindrical holes, each of the cylindrical holes partially extending from the top surface toward the bottom surface, each of the cylindrical holes having an inner side surface and an inner bottom surface, the inner bottom surface being flat and parallel to the bottom surface, each of the cylindrical holes being disposed at a predetermined distance from one another, the bottom surfaces of the dielectric bodies being joined together such that each of the cylindrical holes in one of the dielectric bodies is aligned with each of the cylindrical holes in the other dielectric body;

a first common electrode means comprised of a first conductive material disposed between a pair of aligned cylindrical holes;

a second common electrode means comprised of a second conductive material disposed between a pair of aligned holes other than the pair of aligned cylindrical holes with the first common electrode means disposed therebetween; and a third conductive material completely covering said dielectric means including the bottom surface of the dielectric bodies except the portions surrounding the first and second common electrode means to thereby form a pair coupling/tuning capacitors between the first common electrode means and the third conductive material covering the inner bottom surface of the aligned cylindrical holes with the first common electrode means disposed therebetween and another pair of coupling capacitors between the second common electrode means and the third conductive material covering the inner bottom surface of the aligned cylindrical holes with the second common electrode means disposed therebetween.

BRIEF DESCRIPTION OF THE DRAWINGS

The above and other objects and features of the present invention will become apparent from the following description of preferred embodiments given in conjunction with the accompanying drawings in which:

FIG. 9 represents a cross sectional view of a single-block dielectric ceramic filter employing a plurality of the inventive re-entrant dielectric ceramic resonators and a pair of coupling/tuning capacitors;

FIG. 11 provides a cross sectional view of the single block dielectric ceramic filter shown in FIGS. 9 and 10 with more than a pair of coupling/tuning capacitors;

FIG. 15 sets forth a cross sectional view of a dual-block dielectric ceramic filter comprised of six re-entrant dielectric ceramic resonators and four coupling/tuning capacitors; and FIG. 16 illustrates view of a dual-block dielectric ceramic filter shown in FIG. 15 with an additional pair of coupling/tuning capacitors.

DETAILED DESCRIPTION OF THE PREFERRED EMBODIMENTS

Wherever appropriate, the same reference numbers will be used throughout the drawings to refer to the same or like parts.

Figure 1:
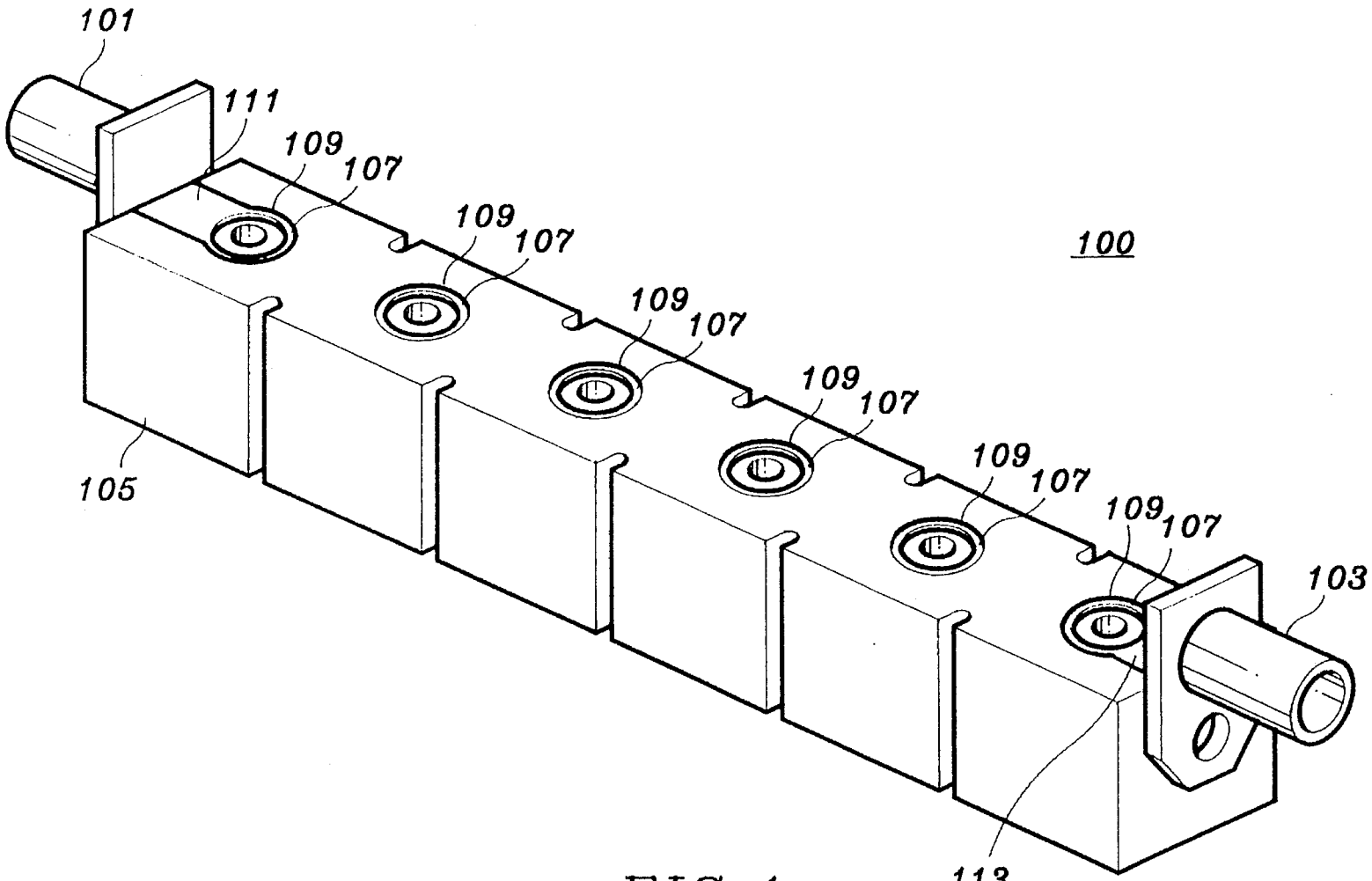
FIG. 1 (PRIOR ART)
FIG. 1 illustrates a perspective view of a conventional dielectric filter.
Figure 4:
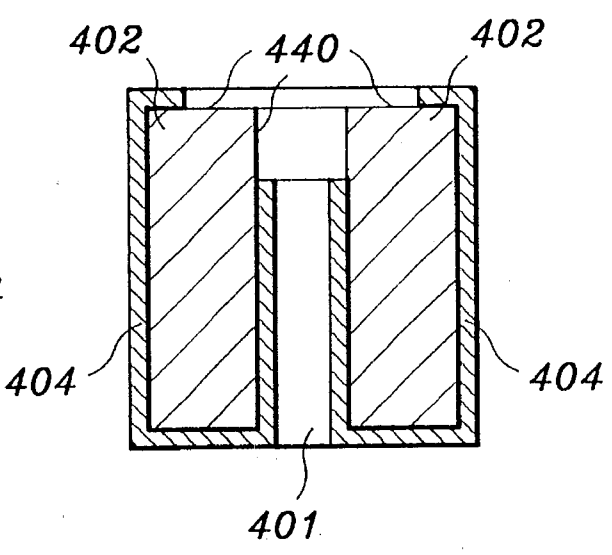
FIG. 4 (PRIOR ART)
FIGS. 2, 3 and 4 show cross sectional views of FIG. 1 illustrating metallization patterns employed in the resonator holes.
Figure 3:
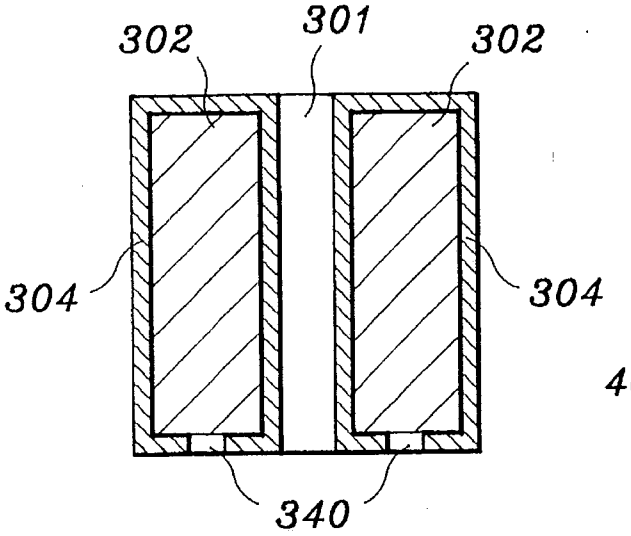
FIG. 3 (PRIOR ART)
Figure 2:
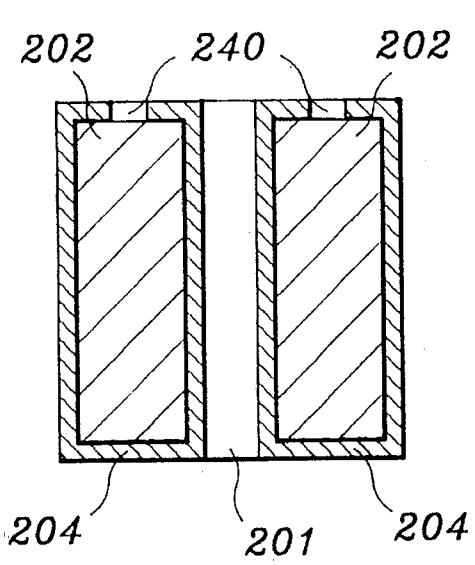
FIG. 2 (PRIOR ART)
Figure 5:
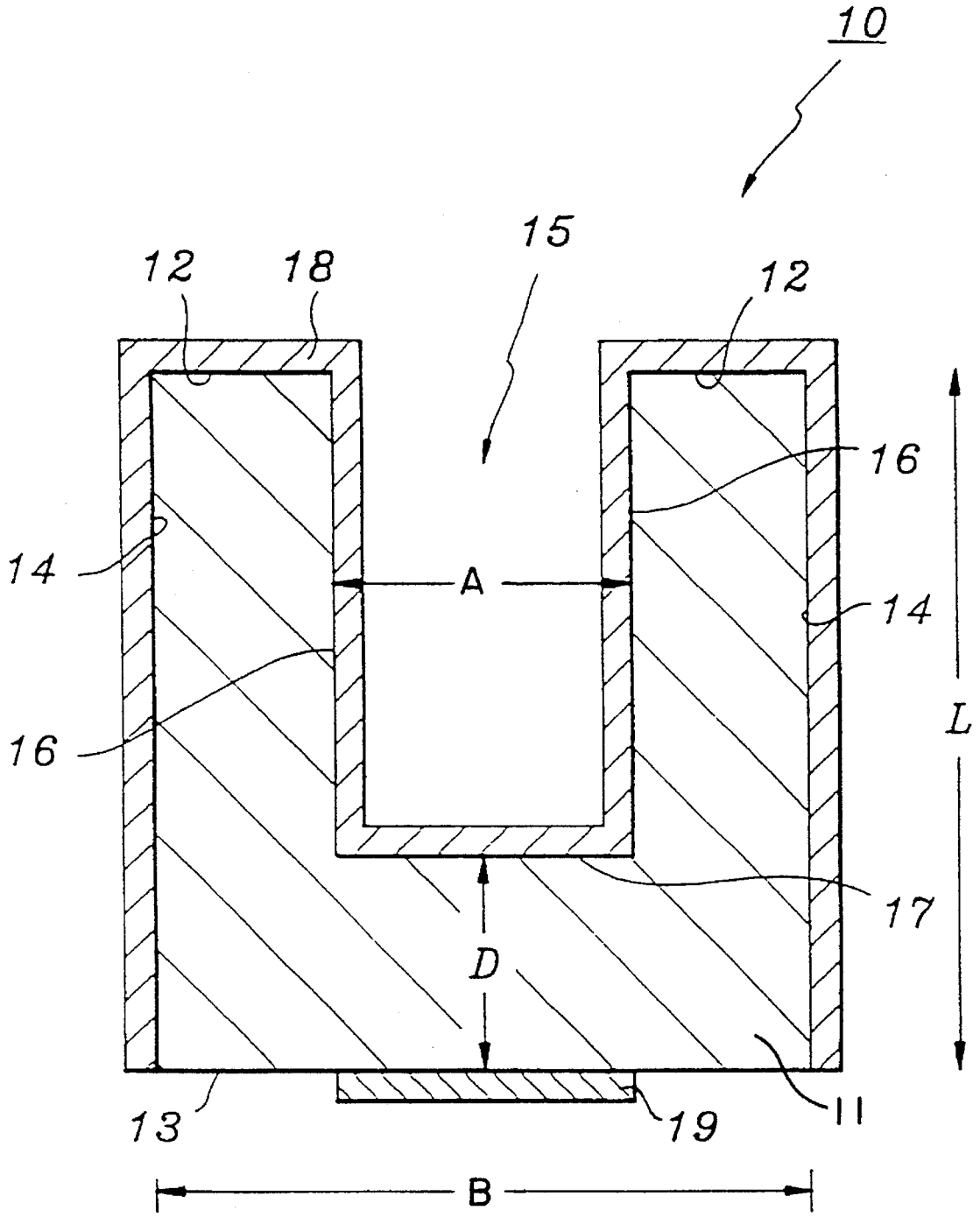
FIG. 5 depicts a cross sectional view of the inventive re-entrant dielectric ceramic resonator.
Figure 6:
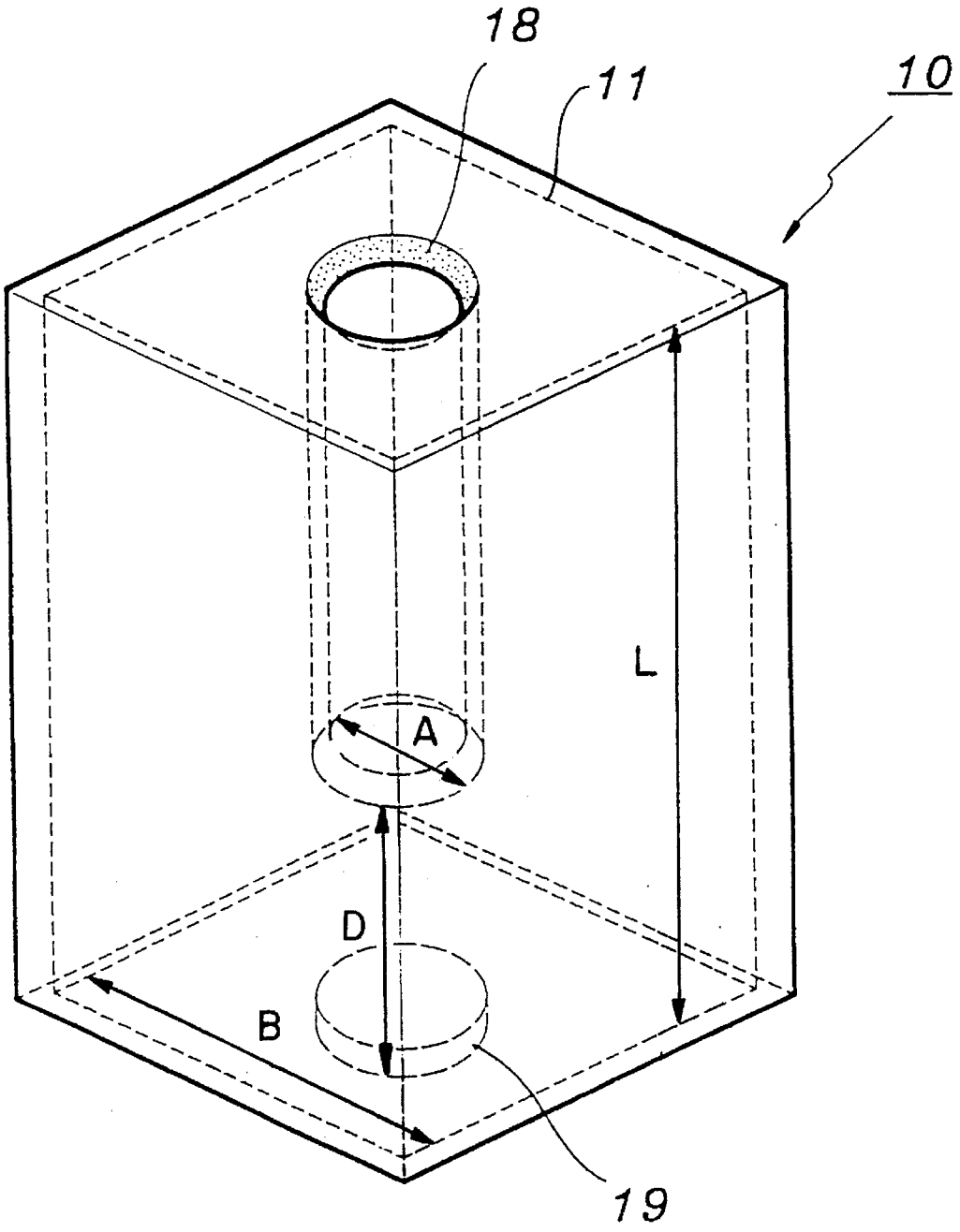
FIG. 6 describes a perspective view of the inventive orthorhombic re-entrant dielectric ceramic resonator.
Figure 7:
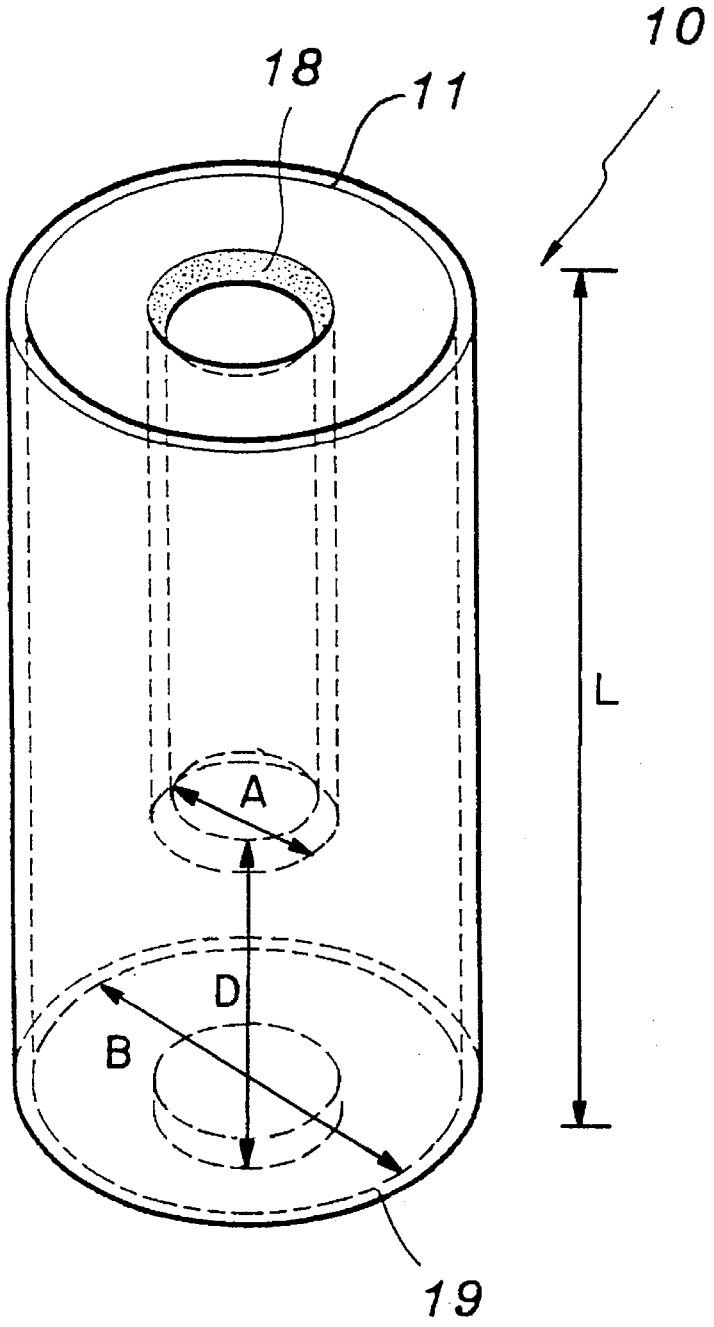
FIG. 7 presents a perspective view of the inventive cylindrical re-entrant dielectric ceramic resonator.

There is illustrated in FIG. 5 a cross sectional view of the inventive re-entrant dielectric ceramic resonator 10 for use in mobile and portable radio transmitting and receiving devices, capable of storing equal amounts of electric and magnetic energies at its resonant frequency, comprising a dielectric means 11 made of a dielectric ceramic material having a top surface 12, a bottom surface 13, and outer side surfaces 14, wherein the top and bottom surfaces 12, 13 are flat and parallel to each other. The dielectric ceramic material making up the dielectric means 11 must have a high dielectric constant, a low loss and a low temperature coefficient of the dielectric constant as exemplified by a ceramic compound comprising a barium oxide, rare-earth oxide and titanium oxide. The dielectric means 11 further has a cylindrical hole 15 formed thereon, extending partially from the top surface 12 toward the bottom surface 13 thereby forming an inner side surface 16 and an inner bottom surface 17, wherein the inner bottom surface 17 is flat and parallel to the bottom surface 13. Furthermore, the top surface 12 and the outer side surfaces 14 of the dielectric means 11 and the inner side surface 16 and the inner bottom surface 17 of the cylindrical hole 15 are covered completely with a first conductive material 18 and the bottom surface 13 of the dielectric means 11 is covered partially with a second conductive material 19 thereby forming a coupling/tuning capacitor between the first conductive material 18 covering the inner bottom surface 17 and the second conductive material 19 partially covering the bottom surface 13, whereby the re-entrant dielectric resonator is constructed. The first and second conductive materials 18, 19 on the inner bottom surface 17 and the bottom surface 13 are respectively electrically isolated in principle and can therefore function as a pair of electrodes. One of these electrodes will be connected to ground and the other, to the input signal source(not shown). The first and second conductive materials 18, 19 can be made of the same material, e.g., silver(Ag) or copper(Cu); and the dielectric means 11 can be, as shown in FIGS. 6 and 7, either orthorhombic or cylindric.

The resonator response characteristics of the inventive re-entrant dielectric ceramic resonator 10 are determined by:

$$f_r = \frac{C}{2\pi\sqrt{\epsilon_r}} \left\{ A \cdot L \left( \frac{A}{2D} - \frac{2}{L} \ln \frac{0.765}{\sqrt{L^2 - (B-A)^2}} \right) \ln \frac{B}{A} \right\}^{-1/2} \quad \text{Eq. (1)}$$

wherein fr=the resonant frequency,

C=the speed of light, $\epsilon_r$=the dielectric constant of the dielectric ceramic material, A=the inner diameter of the cylindrical hole 15, B=the outer diameter when the dielectric means 11 is cylindric (FIGS. 5 and 7) or the width when the dielectric means 11 is orthorhombic (see FIGS. 5 and 6), L=the height of the dielectric means 11, and D=the distance between the inner bottom surface 17 of the cylindrical hole 15 and the bottom surface 13 of the dielectric means 11.

The above equation has been derived by using the procedure described in, for example, Kazuo Fujisawa, "General Treatment of Klystron Resonant Cavities", *IRE Transactions on Microwave Theory and Techniques*, Vol. MTT-6, No. 4, October 1958, Pages 344–357.

There is listed in Table 1 a set of exemplary dimensions of the inventive re-entrant dielectric ceramic resonators with the corresponding resonant frequency($f_r$) values calculated in accordance with Eq.(1), with the assumption that the dielectric constant ($\epsilon_r$) of the ceramic material is 50.

TABLE 1

Resonant frequency of re-entrant dielectric ceramic resonators

| B(cm) | L(cm) | A(cm) | D(cm) | $f_r$(GHz) |
|---|---|---|---|---|
| 0.5 | 0.5 | 0.2 | 0.05 | 2.3337 |
| 0.5 | 0.75 | 0.2 | 0.05 | 1.2437 |
| 0.5 | 1.00 | 0.2 | 0.05 | 0.9741 |
| 0.5 | 1.25 | 0.2 | 0.05 | 0.8385 |
| 0.5 | 1.5 | 0.2 | 0.05 | 0.7531 |
| 0.5 | 2.0 | 0.2 | 0.05 | 0.6469 |

The resonator response characteristics of the inventive re-entrant dielectric ceramic resonators are mainly determined by the dimension of the dielectric means and the cylindrical hole formed thereon.

Figure 8C:
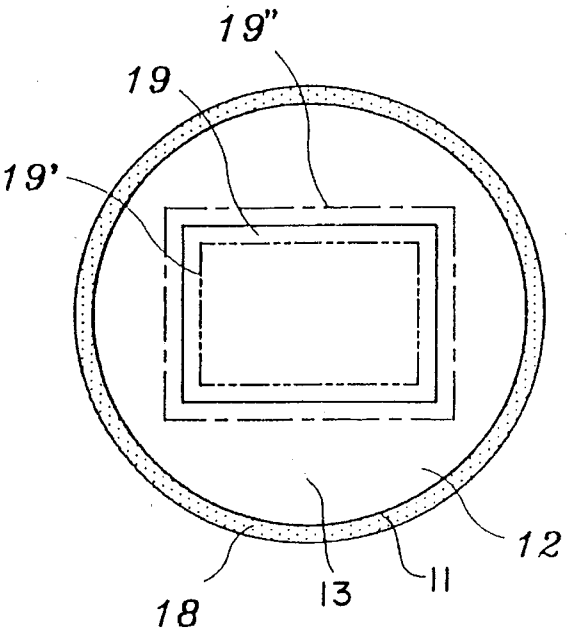
FIGS. 8A to 8C offer electroding patterns formed employed on the bottom surface of the inventive re-entrant dielectric ceramic resonator.
Figure 8B:
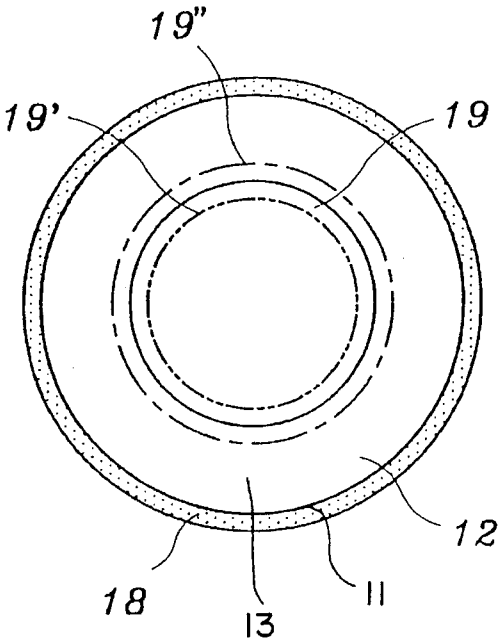
Figure 8A:
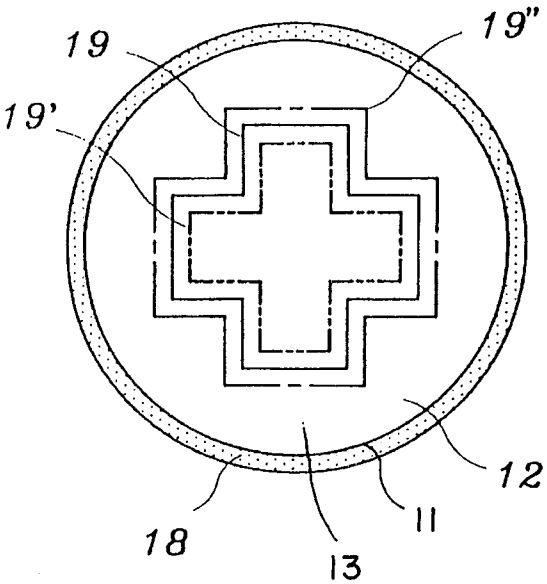

The resonator response characteristics, especially the resonant frequency, can further be fine-tuned by controlling the capacitance of the coupling/tuning capacitor formed between the first conductive material 18 covering the inner bottom surface 17 and the second conductive material 19 partially covering the bottom surface 13 of the dielectric means 11 by controlling the dimension and the shape of the second conductive material 19 deposited on the bottom surface 13 of the dielectric means 11. There are shown in FIGS. 8A to 8C a number of different electroding patterns, e.g., 19, 19', 19", that may be formed on the bottom surface 13 of the dielectric means 11.

It is possible to construct dielectric ceramic filters comprising a plurality of the above-described re-entrant dielectric ceramic resonators depending upon the filter response characteristics desired, two of which are described below.

Figure 10:
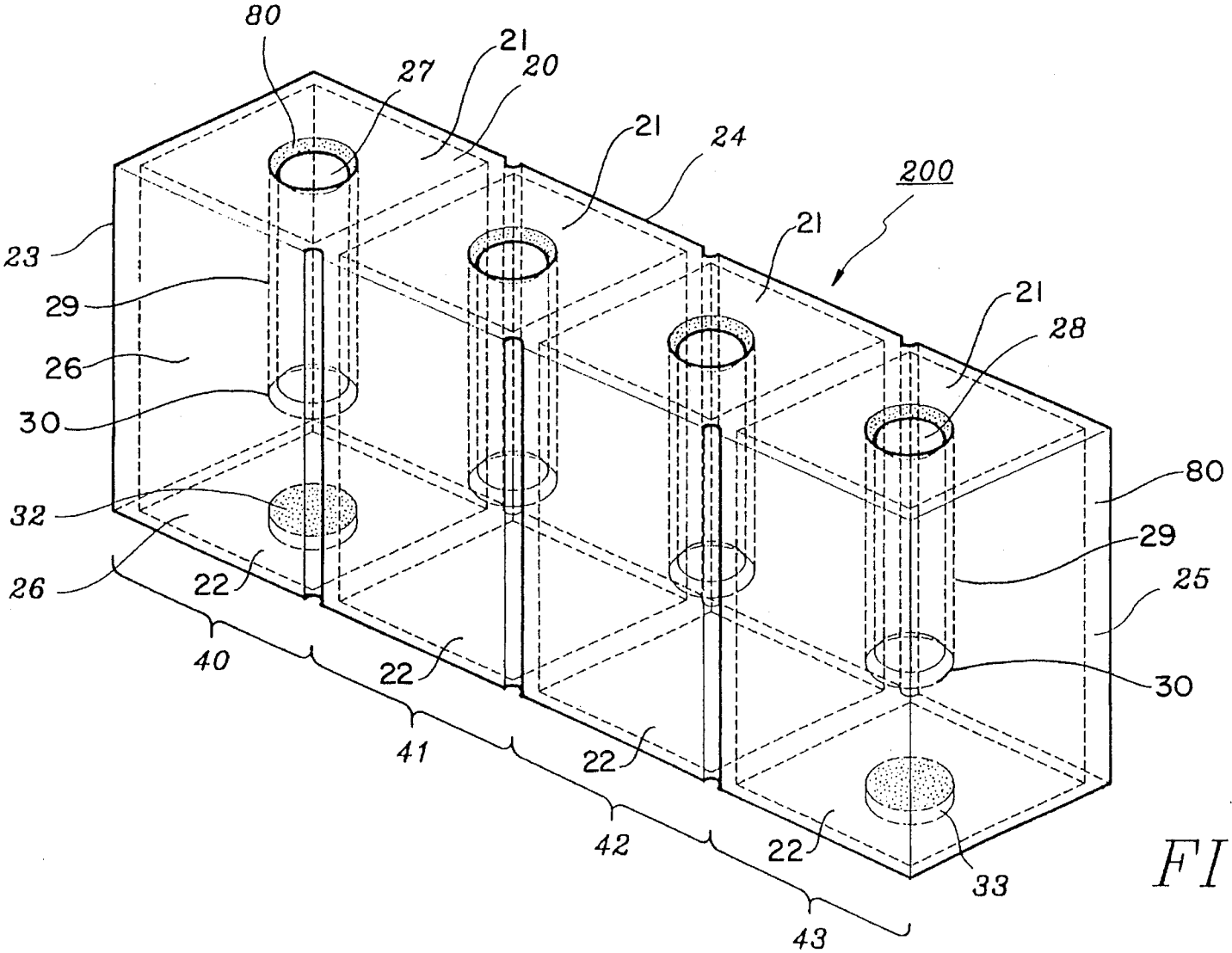
FIG. 10 is a three-dimensional view of the single-block dielectric ceramic filter employing a plurality of the inventive re-entrant dielectric ceramic resonators and a pair of coupling/tuning capacitors.

As a first exemplary embodiment, there are illustrated in FIGS. 9 and 10 a cross-sectional view and a three-dimensional view of an inventive single-block dielectric ceramic filter 200, made of a plurality of the above-described re-entrant dielectric ceramic resonators, comprising a dielectric means 20 made of a dielectric ceramic material in the shape of a parallelepiped having a top surface 21, a bottom surface 22, and four outer side surfaces 23, (see FIG. 10) 24', (see FIG. 10) 25, 26, wherein the top and bottom surfaces 21, 22 are flat and parallel to each other. The dielectric means 20 is further provided with at least two cylindrical holes, e.g., 27, 28, each of the holes partially extending from the top surface 21 toward the bottom surface 22 thereof, each of the holes having an inner side surface 29 and an inner bottom surface 30, the inner bottom surface 30 being flat and parallel to the bottom surface 22 and each of the holes being disposed at a predetermined distance from one another. The dielectric ceramic material comprising the dielectric means 20 is characterized by a high dielectric constant, a low loss and a low temperature coefficient of the dielectric constant. The dielectric means 20 is further provided with a first electrode means 32 comprised of a first conductive material, e.g., Ag or Cu, and a second electrode means 33 comprised of a second conductive material, e.g., Ag or Cu, on the bottom surface 22 thereof, wherein the first electrode means 32 is located below one of the cylindrical holes thereof, e.g., 27, and the second electrode means 33 is located below a cylindrical hole, e.g., 28, other than the one under which the first electrode means 32 is located.

Furthermore, the dielectric means 20 is completely covered, including the inner side surfaces 29 and the inner bottom surface 30, with a third conductive material 80' (see FIG. 9), e.g., Ag or Cu, with the exception of the portions surrounding the first and second electrode means 32, 33 to thereby form a pair of coupling/tuning capacitors between the first and second electrode means 32, 33 and the third conductive material 80 covering the inner bottom surfaces 30 of the cylindrical holes located above the respective electrode means 32, 33, whereby a re-entrant resonator is produced for each cylindrical hole.

Each of the re-entrant resonators 40, 41, 42, 43 has a different resonant frequency and when more than two such resonators are combined, it can be made into a filter. The filter response characteristics of the single-block dielectric ceramic filter 200 can be controlled and fine tuned by controlling the dimension of the dielectric means 20, the dimension and location of the cylindrical holes formed thereon and/or the capacitance of the coupling/tuning capacitors.

In the single-block dielectric ceramic filter 200 the input and output signals are coupled to the first and second electrode means 32, 33, respectively, and the third conductive material 80 covering the dielectric means 20 is coupled to signal ground.

Figure 12:
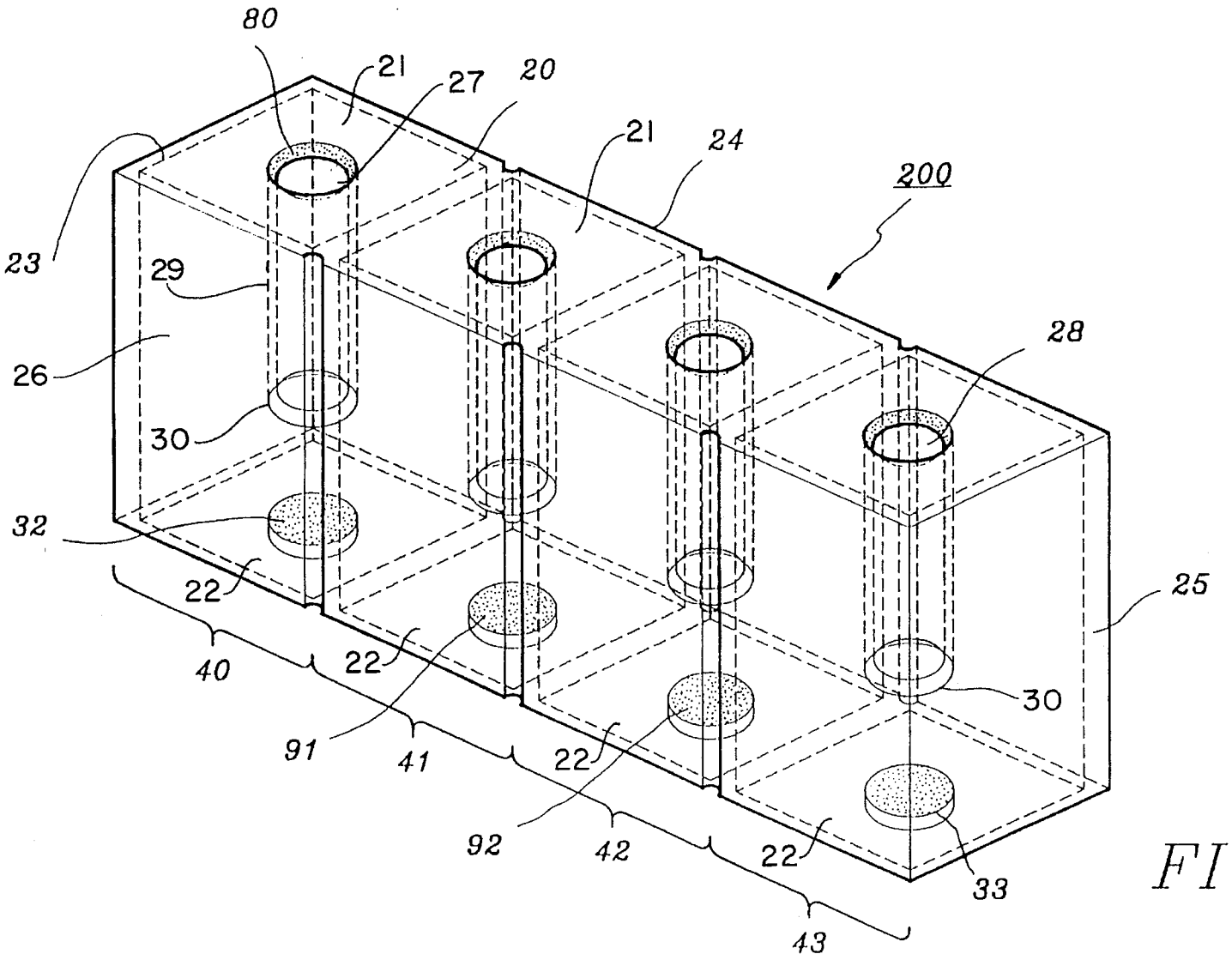
FIG. 12 shows a three-dimensional view of the single block dielectric ceramic filter shown in FIGS. 9 and 10 with more than a pair of coupling/tuning capacitors.

Although the single-block dielectric ceramic filter 200 shown in FIGS. 9 and 10 is comprised of four re-entrant dielectric ceramic resonators and a pair of coupling/tuning capacitors 32, 33 coupled to the input and output signals, any number of re-entrant dielectric ceramic resonators and coupling/tuning capacitors may be utilized, as shown in FIGS. 11 and 12, depending upon the filter response characteristics desired, with a condition that the number of coupling/tuning capacitors does not exceed the number of re-entrant dielectric ceramic resonators. FIGS. 11 and 12 illustrate a cross-sectional view and a three-dimensional view of the inventive single-block dielectric ceramic filter shown in FIGS. 9 and 10 with more than a pair of coupling/tuning capacitors. In FIGS. 11 and 12, the additional coupling/tuning capacitors are formed between the third conductive material 80 covering the inner bottom surface 30 of the cylindrical hole in the re-entrant dielectric ceramic resonator 41 and a fourth electrode material 91 partially covering the corresponding bottom surface 22, and between the third conductive material 80 covering the inner bottom surface 30 of the cylindrical hole in the re-entrant dielectric ceramic resonator 42 and a fifth electrode material 92 partially covering the corresponding bottom surface 22. By controlling the dimension of the fourth and fifth electrode materials 91, 92, the filter response characteristics can be further fine-tuned. The first, second, third, fourth and fifth conductive materials 32, 33, 80, 91, 92 can all be made of the same material, e.g., Ag or Cu.

Figure 13:
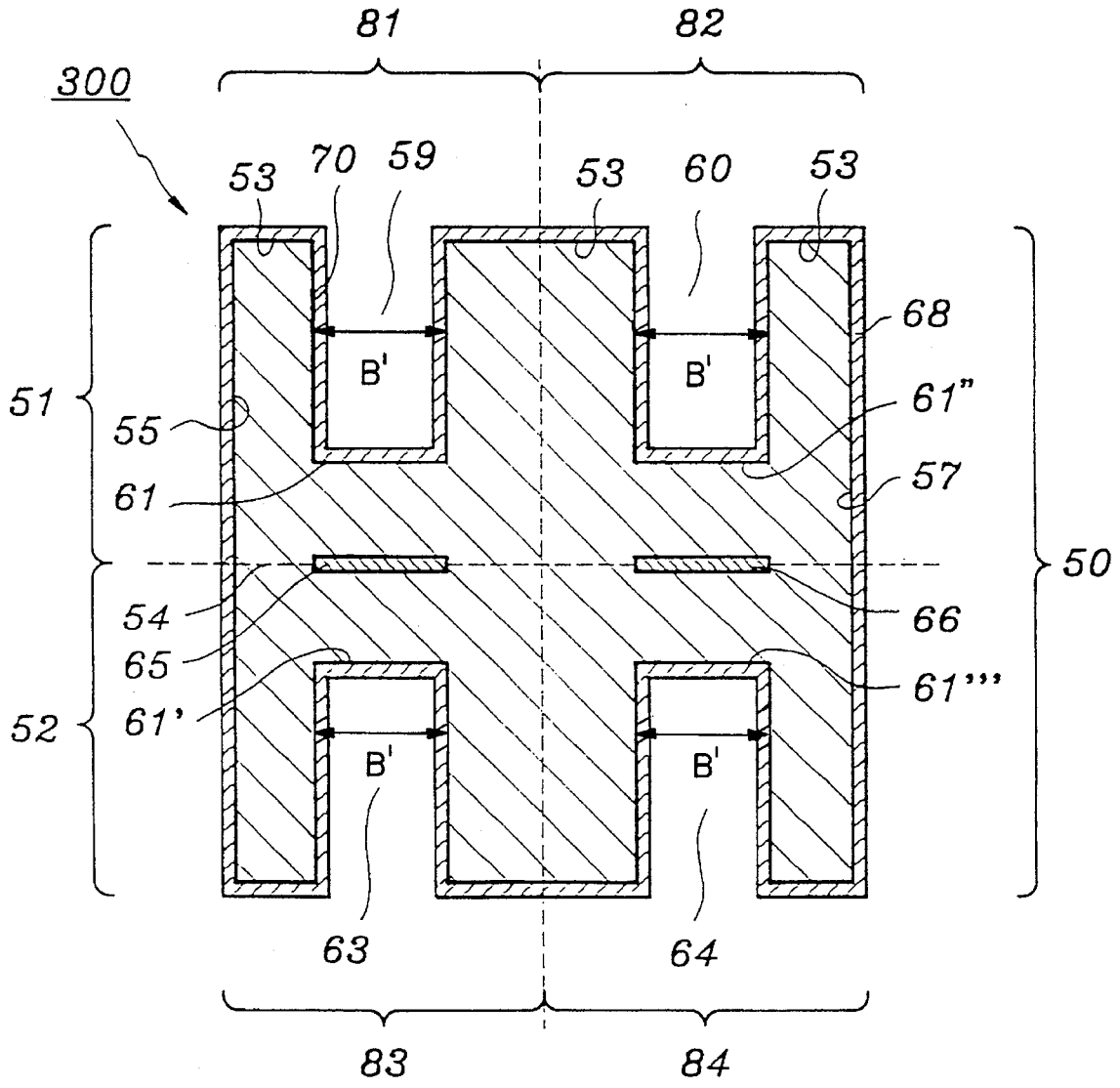
FIG. 13 displays across sectional view of a dual-block dielectric ceramic filter employing a plurality of the inventive re-entrant dielectric ceramic resonators and four coupling/tuning capacitors.
Figure 14:
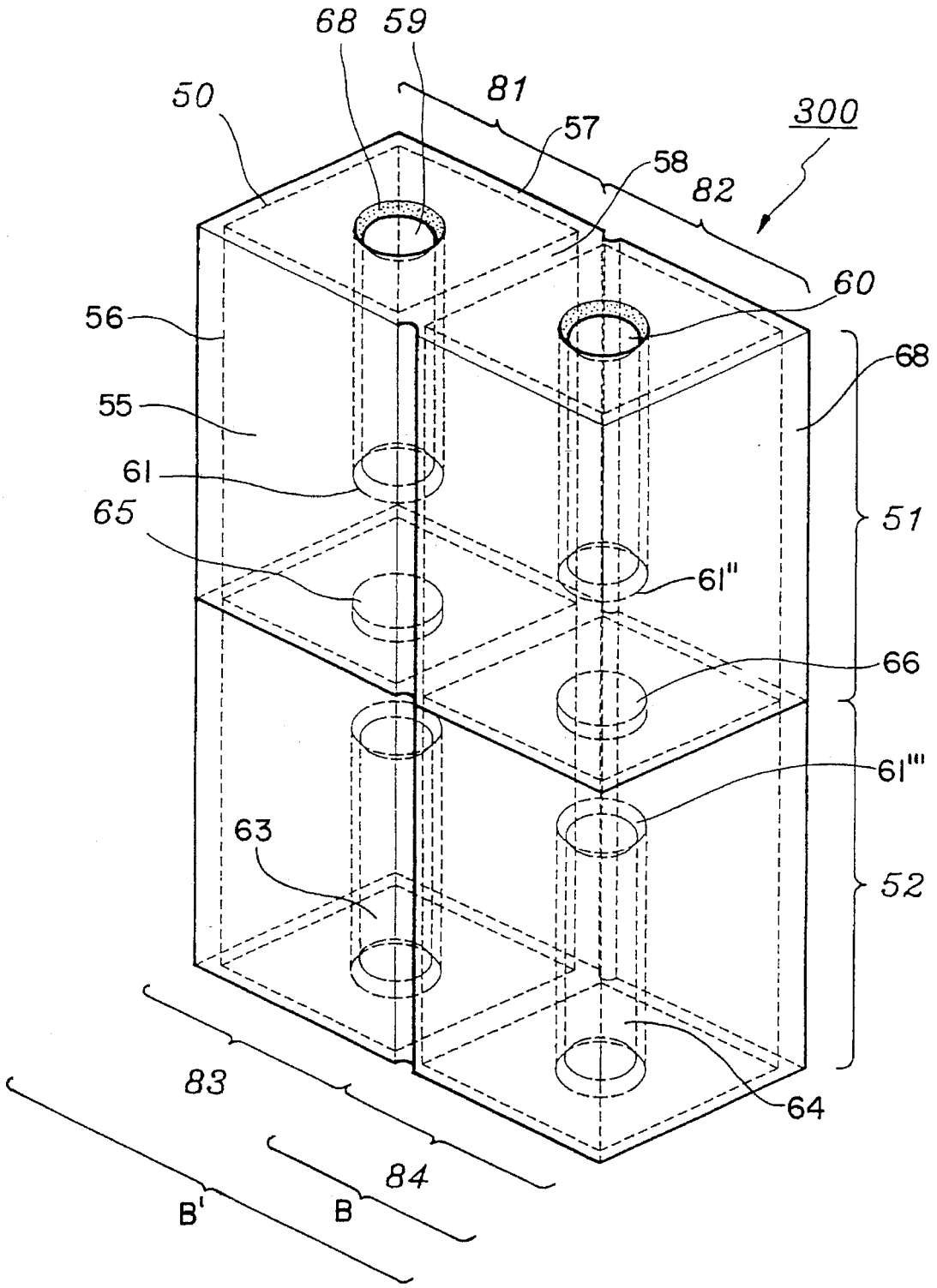
FIG. 14 exhibits a three-dimensional view of the dual-block dielectric ceramic filter employing a plurality of the inventive re-entrant dielectric ceramic resonators and four coupling/tuning capacitors.

As a second preferred embodiment, there are illustrated in FIGS. 13 and 14 a cross sectional view and a three-dimensional view of an inventive dual-block dielectric ceramic filter 300, made of a multiplicity of the above-described re-entrant dielectric ceramic resonators, comprising a dielectric means 50 including a pair of dielectric bodies 51, 52, wherein each dielectric body is made of a dielectric ceramic material in the shape of a parallelepiped, having a top surface 53, a bottom surface 54 and four side surfaces 55, 56, 57, 58, the top and bottom surfaces 53, 54 being flat and parallel to each other.

The dielectric ceramic material constituting the dielectric bodies 51, 52 is characterized by a high dielectric constant, a low loss and a low temperature coefficient of the dielectric constant. Each of the dielectric bodies, e.g., 51, is further provided with at least two cylindrical holes, e.g., 59, 60, wherein each of the cylindrical holes, e.g., 59, partially extends from the top surface 53 toward the bottom surface 54 thereof thereby generating a corresponding inner side surface 70 and an inner bottom surface 61, the inner bottom surface 61 being flat and parallel to the bottom surface 54, each of the cylindrical holes being disposed at a predetermined distance from one another. Furthermore, the bottom surfaces 54 of the dielectric bodies 51, 52 are joined together such that each of the-cylindrical holes, e.g., 59, in one of the dielectric bodies, e.g., 51, is aligned with each of the cylindrical holes, e.g., 63, in the other dielectric body 52. In addition, the dielectric means 50 is provided with a first common electrode means 65, comprised of a first conductive material, e.g., Ag or Cu, disposed between a pair of aligned cylindrical holes, e.g., 59, 63, and a second common electrode means 66, comprised of a second conductive material, e.g., Ag or Cu, disposed between a pair of aligned cylindrical holes, e.g., 63, 64, other than the pair of aligned cylindrical holes with the first common electrode means 65 disposed therebetween.

Furthermore, the dielectric means 50 is completely covered with a third conductive material 68 made of, e.g., Ag or Cu, including the bottom surface 54 of the dielectric bodies 51, 52 except the portions surrounding the first and second common electrode means 65, 66 to thereby form a plurality of coupling/tuning capacitors between the first common electrode means 65 and the third conductive material 68 covering the inner bottom surfaces 61, 61 of the pair of aligned cylindrical holes 59, 63 and the second common electrode means 66 and the third conductive material 68 covering the inner bottom surfaces 61", 61''' of the pair of aligned cylindrical holes 60, 64, whereby a re-entrant resonator is produced for each cylindrical hole. In constructing a filter having the same number of poles, i.e., resonators, the dielectric ceramic filter constructed in the above described manner will have a width(B') which will be half the width of the single-block dielectric ceramic filter having the same number of poles.

Each of the re-entrant dielectric resonators 81 82, 83, 84 has a different resonant frequency and when more than two such resonators are combined, it can be made into a filter. The filter response characteristics of the dual-block dielectric ceramic filter can be controlled and fine tuned by controlling the dimension of the dielectric bodies, hence the dielectric means, the dimension and location of the cylindrical holes formed thereon, and/or the capacitance of the coupling/tuning capacitors.

In the dual-block dielectric ceramic filter the input and output signals are coupled to the first and second common electrode means 65, 66, respectively, and the third conductive material 68 covering the dielectric means 50 is coupled to signal ground.

Although the dual-block dielectric ceramic filter 300 shown in FIGS. 13 and 14 is comprised of four re-entrant dielectric ceramic resonators and the corresponding number of coupling/tuning capacitors, any number of re-entrant dielectric ceramic resonators may be utilized depending upon the filter response characteristics desired with a condition that the number of coupling/tuning capacitors does not exceed the number of re-entrant dielectric ceramic resonators. As an exemplary embodiment of another dual-block dielectric ceramic filter incorporating the present invention, there is illustrated in FIG. 15 a cross sectional view of a dual-block dielectric ceramic filter 500 comprising six re-entrant dielectric ceramic resonators 85, 86, 87, 88, 89, 90 and four coupling/tuning capacitors.

As another exemplary embodiment of another dual-block dielectric ceramic filter incorporating the present invention, there is illustrated in FIG. 16 a cross sectional view of the dual block ceramic filter 500 shown in FIG. 15 with an additional pair of coupling/tuning capacitors formed between the third conductive material 68 covering the inner bottom surface 69 of the cylindrical hole 71 of the re-entrant dielectric ceramic resonator 86 and a third common electrode means 93 partially covering the corresponding bottom surface 54, and between the third conductive material 68 covering the inner bottom surface 69' of the cylindrical hole 72 of the re-entrant dielectric ceramic resonator 89 and the third common electrode means 93 partially covering the corresponding bottom surface 54. The filter response characteristics can be further fine-tuned by controlling the dimension of the third common electrode means 93. The first common electrode means 65, the second common electrode means 66, the third conductive material 68 and third common electrode means 93 can be made of the same material.

While the present invention has been shown and described with reference to the particular embodiments, it will be apparent to those skilled in the art that many changes and modifications may be made without departing from the spirit and scope of the invention defined in the appended claims.

What is claimed is:

1. A dual-block dielectric ceramic filter comprising:

a dielectric means consisting of a pair of dielectric bodies, each of the dielectric bodies comprised of a respective dielectric ceramic material having a top surface, a bottom surface and four outer side surfaces, each of the top and the bottom surfaces being flat and parallel to each other, each of said dielectric bodies having at least two cylindrical holes disposed therein, each of the respective cylindrical holes partially extending from the respective top surface toward the corresponding bottom surface, each of the cylindrical holes having a respective inner side surface and a respective inner bottom surface, the inner bottom surface being flat and parallel to the corresponding bottom surface, a respective one of the cylindrical holes being disposed at a predetermined distance from another one of the cylindrical holes, the respective bottom surfaces of the pair of dielectric bodies being fixed together such that a respective one of the cylindrical holes in one of the dielectric bodies is aligned with a corresponding one of the cylindrical holes in the other dielectric body to define a respective pair of aligned cylindrical holes;

a first common electrode means comprised of a first conductive material disposed between a respective pair of aligned cylindrical holes;

a second common electrode means comprised of a second conductive material disposed between a respective pair of aligned holes other than the pair of aligned cylindrical holes with the first common electrode means disposed therebetween; and a third conductive material completely covering said dielectric means including the bottom surfaces of the dielectric bodies except the portions surrounding the first and the second common electrode means to thereby define a pair of coupling/tuning capacitors between the first common electrode means and re-entrant dielectric ceramic resonators defined by the third conductive material covering the inner bottom surfaces and the inner side surfaces of the aligned cylindrical holes with the first common electrode means disposed therebetween and, another pair of coupling capacitors between the second common electrode means and other re-entrant dielectric ceramic resonators defined by the third conductive material covering the inner bottom surfaces and the inner side surfaces of the aligned cylindrical holes with the second common electrode means disposed therebetween.

2. The dual-block dielectric ceramic filter of claim 1, wherein the number of re-entrant dielectric ceramic resonators and coupling/tuning capacitors is determined by the filter response characteristics desired.

3. The dual-block dielectric ceramic filter of claim 2, wherein the number of coupling/tuning capacitors does not exceed the number of re-entrant dielectric ceramic resonators.

4. The dual-block dielectric ceramic filter of claim 1, wherein one of the common electrode means functions as an input signal electrode and the other common electrode means functions as an output signal electrode, and the third conductive material covering said dielectric means is coupled to signal ground.

5. The dual-block dielectric ceramic filter of claim 1, wherein the first, the second and the third conductive materials are comprised of a same conductive material.

* * * * *